US008333411B2

(12) United States Patent
Blanch

(10) Patent No.: US 8,333,411 B2
(45) Date of Patent: Dec. 18, 2012

(54) LOCK MECHANISM

(75) Inventor: David Blanch, Notting Hill (AU)

(73) Assignee: ASSA ABLOY Australia Pty Limited (AU)

( * ) Notice: Subject to any disclaimer, the term of this patent is extended or adjusted under 35 U.S.C. 154(b) by 613 days.

(21) Appl. No.: 12/309,914

(22) PCT Filed: Jul. 30, 2007

(86) PCT No.: PCT/AU2007/001059

§ 371 (c)(1),
(2), (4) Date: Oct. 8, 2009

(87) PCT Pub. No.: WO2008/014542

PCT Pub. Date: Feb. 7, 2008

(65) Prior Publication Data

US 2010/0032969 A1 Feb. 11, 2010

(30) Foreign Application Priority Data

Aug. 1, 2006 (AU) ..... 2006904162

(51) Int. Cl.

| | |
|---|---|
| ***E05C 5/00*** | (2006.01) |
| ***E05C 9/00*** | (2006.01) |
| ***E05C 1/12*** | (2006.01) |
| ***E05B 15/02*** | (2006.01) |

(52) U.S. Cl. ..... 292/5; 292/12; 292/158; 292/341.16

(58) Field of Classification Search ..... 292/5, 12, 292/137, 158, 201, 341.16, 341.17, 341.18, 292/341.19, 340; 70/91

See application file for complete search history.

(56) References Cited

U.S. PATENT DOCUMENTS

| | | | | | |
|---|---|---|---|---|---|
| 4,867,496 | A | * | 9/1989 | Thomas | 292/341.16 |
| 4,986,584 | A | | 1/1991 | Logas | |
| 5,219,196 | A | * | 6/1993 | Luker | 292/341.16 |
| 5,474,348 | A | * | 12/1995 | Palmer et al. | 292/359 |
| 5,681,070 | A | | 10/1997 | Williams et al. | |
| 5,806,355 | A | * | 9/1998 | Lanigan et al. | 70/257 |
| 5,934,720 | A | * | 8/1999 | Karalius | 292/341.16 |
| 6,082,791 | A | * | 7/2000 | Frolov et al. | 292/341.16 |

(Continued)

FOREIGN PATENT DOCUMENTS

GB 2 096 687 A 10/1982

(Continued)

OTHER PUBLICATIONS

International Search Report issued on Sep. 13, 2007 in connection with corresponding International Appln. No. PCT/AU2007/001059.

*Primary Examiner* — Thomas Beach
*Assistant Examiner* — Nathan Cumar
(74) *Attorney, Agent, or Firm* — Lerner, David, Littenberg, Krumholz & Mentlik, LLP

(57) ABSTRACT

This invention relates to an electrically controlled lock assembly (1) including a housing (10) and a retainer (6) mounted on the housing for movement relative thereto between an open and closed position. The lock assembly also includes locking means (12) including a detent (21) that when retained in an active position stops the retainer from moving relative to the housing. The lock assembly also includes an electrical actuator (14) being operable to cause the (10) retaining means to adopt a locked or released condition.

19 Claims, 6 Drawing Sheets

U.S. PATENT DOCUMENTS

| | | | | |
|---|---|---|---|---|
| 6,174,004 | B1 * | 1/2001 | Picard et al. | 292/165 |
| 6,595,563 | B2 * | 7/2003 | Kiernan | 292/341.16 |
| 6,595,564 | B1 * | 7/2003 | Hanchett et al. | 292/341.16 |
| 7,032,863 | B1 * | 4/2006 | Piorkowski et al. | 244/129.4 |
| 2002/0145292 | A1 * | 10/2002 | Furner | 292/341.16 |
| 2003/0132232 | A1 * | 7/2003 | Eggum | 220/323 |

FOREIGN PATENT DOCUMENTS

| | | | |
|---|---|---|---|
| GB | 2 364 742 | A | 2/2002 |
| WO | 2004/029391 | A1 | 4/2004 |

* cited by examiner

LOCK MECHANISM

FIELD OF THE INVENTION

This invention relates to a lock mechanism for use in a lock assembly intended to secure a movable member such as a door in a closed position relative to a frame. The invention also relates to a lock assembly incorporating the lock mechanism, and an electric strike assembly. It will be convenient to hereinafter describe the invention with particular reference to doors, but the invention has wider application.

BACKGROUND OF THE INVENTION

One type of lock assembly of the foregoing kind is an electrically controlled strike assembly generally mounted on or in the frame surrounding the door. In particular the strike assembly is often mounted in a cavity formed in a vertical frame element A bolt, most often a latch bolt, is located on the door so as to engage a strike element, referred to hereinafter as a keeper, of the electric strike assembly when the door is in the closed position. While a handle may be provided, the handle is not operably connected to the latch bolt to enable its retraction to a release position. Instead where the strike assembly is in an unlocked condition the keeper is moved to a release position by the user applying a force to the door, possibly via the handle, to move the door from the closed position. Where the strike assembly is in a locked condition, the user must unlock the strike assembly before the keeper can be moved towards the release position.

The strike assembly includes a locking means which when operable restrains the keeper from moving towards the release position. The locking means generally has a detent which moves along a path from an active position to an inactive position to render the locking means inoperable. In the case of the strike assembly the detent is in the form of one or more pins that are moveable along a path defined by a bore extending between the keeper and a housing supporting the keeper. When the locking means is operable the one or more gins extend across a shear line between the keeper and the housing, to stop the keeper from being moved relative to the housing. An electrical controller, Generally a solenoid or a motor and gearing arrangement, can be utilized to move the one or more pins axially of the bore so that they do not extend across the shear line and thereby render the locking means inoperable.

Other types of lock assembly which are used to secure a door in a closed position include a mortice lock assembly or a rim lock assembly. These types of lock assemblies include a bolt that is movable relative to a housing between an extended locked position and a retracted release position. A hand operable actuator operable by movement of a turn knob or lever is generally used to at least retract the bolt from the extended position. A detent is included that when held in an active position renders the bolt immovable or the actuator inoperable. An electrical controller such as a solenoid or motor and gearing arrangement can be utilized to move the detent along a path from the active position.

A problem can arise when the lock assembly is in a locked condition and a force is applied to the keeper or hand operable actuator urging the keeper or bolt towards a release position before the electrical controller is operated. This is often referred to as preload. Movement of the detent along the path will create friction with the walls defining the path. The output of the electrical controller is generally limited due to size constraints of the lock housing and as a result it can not overcome the frictional forces acting on the detent This results in the detent being stuck in the active position.

It is generally desirable that the electrically controlled lock assembly respond to an electricity supply failure in a manner that suits the location in which the assembly is installed. More specifically in the event of an electricity supply failure it is generally desirable for the lock assembly to be operable in either a fail safe or fail secure mode, so that the locking means is rendered inoperable or operable respectively. It is also generally desirable that the lock assembly be easily adjustable between fail safe and fail secure when being installed.

The above discussion of assemblies and the like is included in this specification solely for the purpose of providing a context for the present invention. It is not suggested or represented that any of these assemblies formed part of the prior art base or were common general knowledge in the field relevant to the present invention as it existed in Australia before the priority date of this invention.

SUMMARY OF THE INVENTION

According to one aspect of this invention there is provided an electric strike assembly for releasably retaining a bolt including:

a housing, a keeper which in use interacts with the bolt, the keeper being mounted on the housing and being movable relative to the housing from a closed position, a locking means that includes a detent that cooperates with the keeper so that when the detent is retained in an active position the keeper is stopped from being moved from its closed position so that in use the keeper retains the bolt, the locking means also includes retaining means that when in a lock condition retains the detent in the active position, and when in a release condition releases the detent for movement from the active position, wherein when the retaining means is in the lock condition, urging the keeper to move relative to the housing urges the retaining means to endeavor to adopt the release condition, where the retaining means is in the release condition the detent is movable from the active position by movement of the keeper relative to the housing from the closed position when releasing the bolt.

It is preferred that the locking means includes retaining means that when in a lock condition retains the detent in the active position, and when in a release condition releases the detent for movement from the active position. It is further preferred that the retaining means includes a moveable member that adopts a first position when the detent is in the active position and moves to a second position when the detent is moved from the active position, the retaining means also including a stop that obstructs movement of the movable member to the second position when the retaining means is in the locked condition. It is further preferred that the movable member pivots about a first axis when moving between the first and second position. It is further preferred that the moveable member includes a driven that engages the stop when the movable member moves towards the second position and the retaining means is in the locked condition. It is further preferred that the driven arm includes a free end that engages the stop when the movable member moves towards the second position and the retaining means is in the locked condition. It is further preferred that the stop rotates about a second axis, the drive arm when engaging the stop applies a force to the stop that is substantially directed towards the second axis. It is further preferred that the retaining means includes a drive member which engages the detent and is connected to the movable member so that movement of the detent from the active position creates a moment around the first axis, the moment having a moment arm which increases as the detent moves from the active position. It is further preferred that the drive member is articulated with one end connected to the movable member and the other end connected to the housing for rotation about the second axis.

It is also preferred that the electric strike assembly include an actuator which interacts with the locking means being operable to cause the retaining means to adopt the locked condition or the release condition. It is further preferred that the actuator interacts with the locking means to enable the locking means to operate in a fail safe mode whereby operation of the actuator causes the retaining means to adopt the locked condition, and operate in a fail secure mode whereby operation of the actuator causes the retaining means to adopt the release condition. It is further preferred that the actuator includes a solenoid having a plunger that retracts on operation of the actuator. It is further preferred that the plunger is adjustably connected to the stop so as to allow adjustment of the position of the stop relative to the free end of the driven arm to adjust the mode of operation of the actuator between fail safe and fail secure.

It is also preferred that the keeper includes a recess to accommodate the detent when the detent is in the active position. It is further preferred that the recess-includes an-angled-side-wall that is engaged by the detent when the detent is in the active position, the angle of the side wall being so as to urge the detent out of the recess when the keeper is moved away from the closed position. It is further preferred that the keeper is biased towards the closed position.

According to a further aspect of this invention there is provided a locking means for use in an electrically controlled lock assembly having a housing and a retainer being mounted on the housing and being movable relative to the housing from an locked position to a release position, the locking means including:

a detent that when retained in an active position the retainer is sloped from being moved from its locked position, the locking means also includes retaining means that when in a lock condition retains the detent in the active position, and when in a release condition releases the detent for movement from the active position, wherein when the retaining means is in the lock condition, urging the retaining to move relative to the housing urges the retaining means to endeavor to adopt the release condition, where the retaining means is in the release condition the decent is movable from the active position by movement of the retainer relative to the housing from the closed position, an electrical actuator which interacts with the locking means being operable to cause the retaining means to adopt the locked condition or the release condition.

It is also preferred that the retainer is a bolt.

It is also preferred that the retainer is a keeper.

It is also preferred that the retaining means includes a moveable member that adopts a first position when the detent is in the active position and moves to a second position when the detent is moved from the active position, the retaining means also including a stop that obstructs movement of the movable member to the second position when the retaining means is in the locked condition.

It will be convenient to hereinafter describe preferred embodiments of the invention in detail with reference to the accompanying drawings. It ought to be appreciated however that the detailed description and the accompanying drawings are merely illustrative of how the invention might be put into effect.

BRIEF DESCRIPTION OF THE DRAWINGS

The specific form and arrangement of the various features shown and described is not to be understood as limiting on the invention. The present invention can be more fully appreciated with reference to the following detailed description, which in turn refers to the drawings in which.

DETAILED DESCRIPTION

Figure 1:
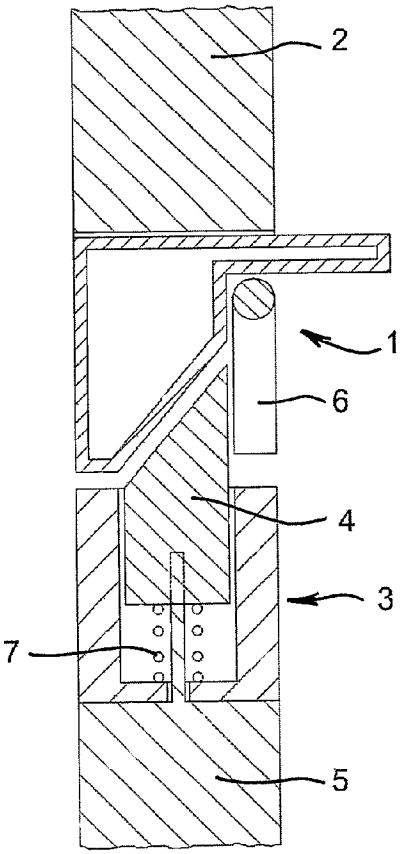
FIG. 1 is a side, elevational, cross-sectional diagrammatic view of an installed electric strike assembly according to a preferred embodiment of the present invention.

FIG. 1 shows, in very diagrammatic form, one type of lock assembly 1 namely an electric strike assembly mounted to an edge of a door frame 2. A latch assembly 3 including a latch bolt 4 is illustrated as mounted to the edge of an adjacent door 5. The electric strike assembly includes a keeper 6 which is shown in FIG. 1 in the closed position. When the keeper is held in the closed position it retains the bolt 4, and therefore stops the door 5 being moved relative to the door frame 2. A handle (not shown) may be included, at least on the outside of the door 5, to facilitate moving the door 5 relative to the frame 2. It ought to be noted however that the handle is not operably connected to the latch bolt 4. More specifically whilst the bolt 4 can be moved to a retracted position while the door 5 is being returned to a closed position, the latch bolt 4 returns to the extended position as shown by operation of a spring 7. It ought to be appreciated that whilst a latch bolt 4 is illustrated, the invention may be also suitable for use with a deadbolt.

The electric strike assembly includes an electric actuator that will be described in greater detail by reference to later illustrations. The actuator may be operated by any suitable means however it is generally operated by either a key tag reader located on an outside of the frame or a switch operated from an inner side of the frame. Clearly other arrangements are possible.

The actuator interacts with a locking means which will be described in greater detail later in the specification. The locking means interacts with the keeper to retain it in the closed position.

Figure 3:
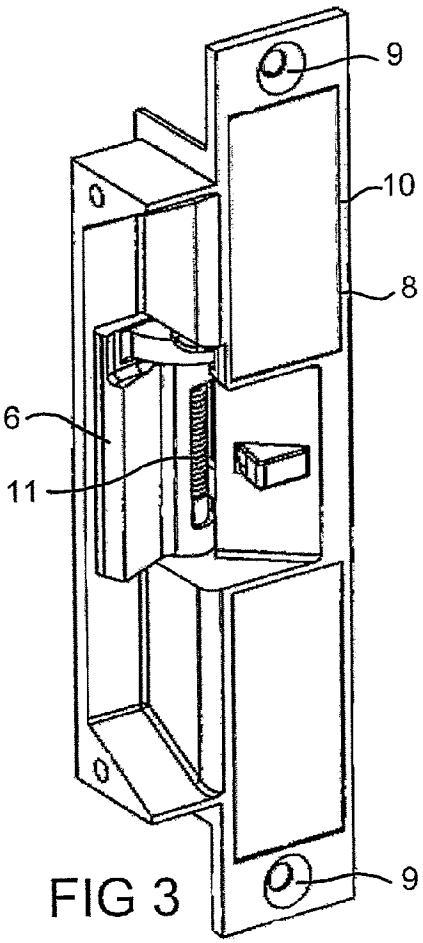
FIG. 3 is a rear, perspective view of a strike assembly from FIG. 2 with the keeper in the open position.
Figure 2:
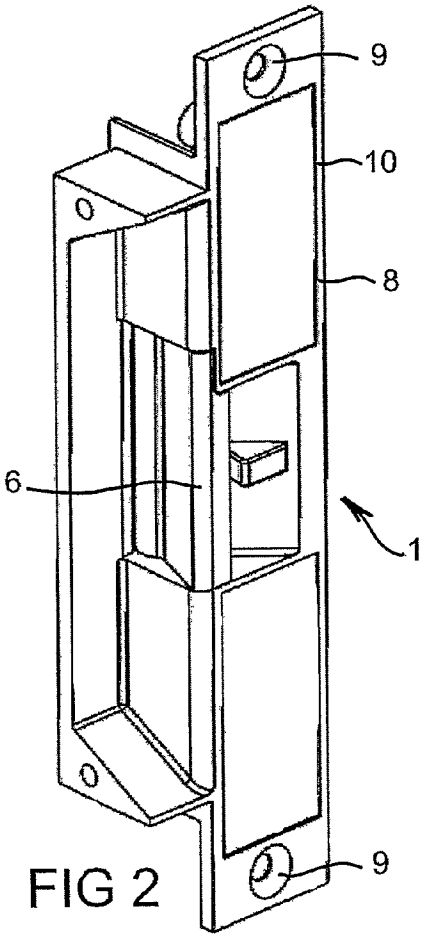
FIG. 2 is a rear, perspective view of a preferred embodiment of the electric strike assembly according to the present invention with a keeper in the closed position.

Referring now to FIG. 2 this illustrates the electric strike assembly having a housing 8. The housing 8 is provided with apertures on a face plate 9 to enable the housing 8 to be attached to the door frame by fasteners such as screws (not shown). The keeper 6 is mounted to the housing 10 for movement relative thereto. FIG. 3 illustrates the keeper 6 having been moved from the closed position shown in FIG. 2. This is achieved by a user opening the door. The keeper 6 is returned to the dosed position by urging of a spring 11 located around a pivot axis of the keeper 6 (see FIG. 3).

Figure 4:
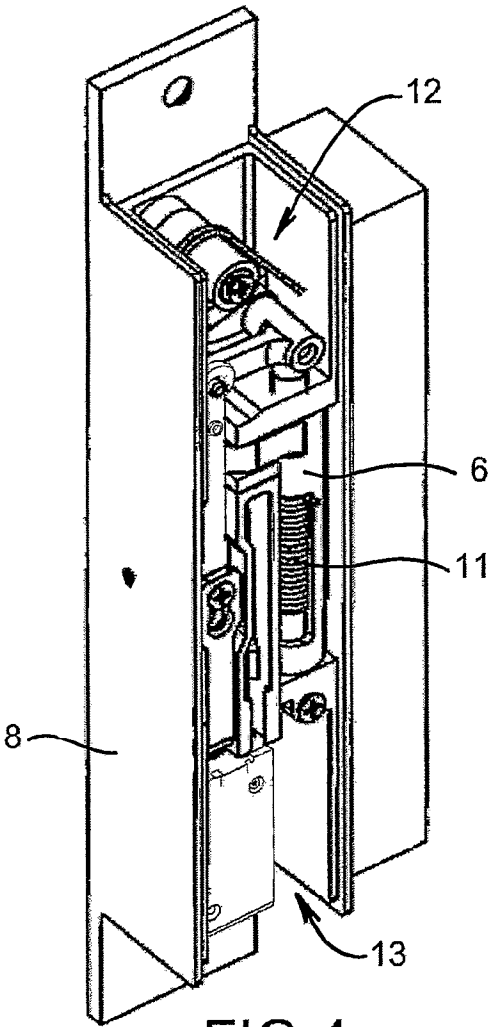
FIG. 4 is a rear perspective view of the electric strike assembly of FIG. 2 with the cover of the housing removed.

Referring now to FIG. 4 which illustrates a rear view of the electric strike assembly with a cover portion of the housing 8 removed. In summary FIG. 4 illustrates the keeper 6, a locking means 12 and electrical actuator 13 mounted to the housing 8. These components are more clearly illustrated in FIG. 5 which reveals the actuator includes a solenoid 14 having a plunger 15 which is biased by a spring 16 towards an extended position. Operation of the actuator involves energization of the solenoid 14 to thereby retract the plunger 15. While the illustrations show a solenoid, this may be replaced by a motor and gear drive assembly.

Figure 6:
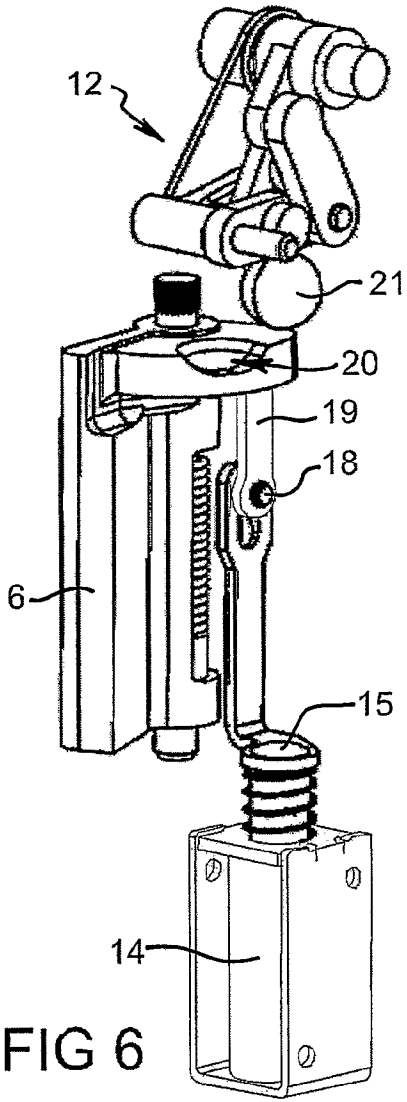
FIG. 6 is a isometric view of the electric strike assembly of FIG. 5 with the detent in an inactive position.

The actuator 13 is preferably connected to the locking means 12 in a manner to enable the locking means 12 to operate in either a fail safe or fail secure mode of operation. This may be achieved in any suitable manner however in a preferred embodiment illustrated this is achieved by the plunger 15 of the actuator 13 being connected to the locking means 12 by a link arm 17, the length of which is adjustable. The length of the link arm 17 is adjustable by adjusting the position of the screw 18 shown approximately at the mid point of the link arm 17. FIG. 6 illustrates the screw being located in a threaded bore formed in an upper link member 19, however this may be substituted by a nut and bolt arrangement. An explanation as to how this adjustment achieves changing the mode of operation of the locking means 12 will be described later in the specification.

Figure 5:
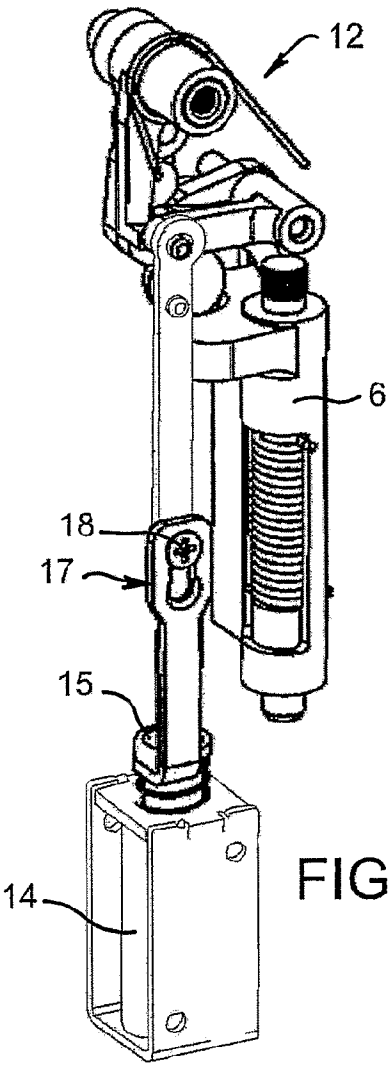
FIG. 5 is a side, perspective view of the electric strike assembly with the housing removed and the detent in an active position.

FIG. 6 also illustrates the keeper 6 including a recess 20 which accommodates a detent 21 when the keeper 6 is in the closed position, as can be seen from FIG. 5. The recess 20 and its interrelationship with the detent 21 will be described in greater detail later in the specification.

Figure 7:
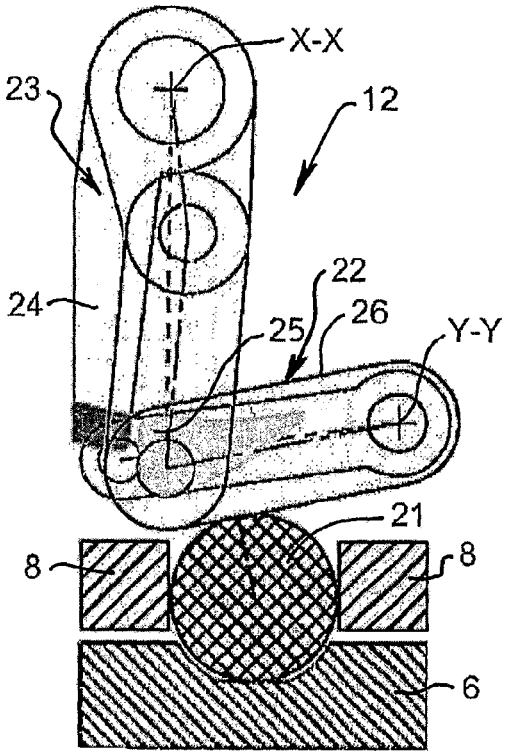
FIG. 7 is a side, elevational diagrammatic view of a locking means of the electric strike assembly of the present invention including a retaining means in a locked condition operating in a fail secure mode.

Referring now to FIG. 7 which illustrates the locking means 12 operating in a fail secure mode. The locking means includes a retaining means 22 that when a lock condition as shown in FIG. 7 retains the detent 21 in the active position within the recess 20 in the keeper 6. The retaining means 22 includes a movable member 23 that adopts a first position when the detent 21 is in the recess as shown in FIG. 7. The movable member 23 pivots about a first axis X-X and includes a driven arm having a free end that engages a stop 25 of the retaining means when the movable member 23 is moved towards a second position (see FIG. 8). The retaining means also includes a drive member 26 that engages the detent 21 and is connected to the movable member 23 so that movement of the detent 21 from the active position encourages the drive member 26 to move about the axis X-X. However the movable member 23 cannot be moved from the first position shown in FIG. 7 while the stop 25 is located in the position in FIG. 7.

In order to enable the detent 21 to move from the active position, the stop 25 must be moved out of the way of the path of the free end of the driven arm 24. This is achieved by operation of the actuator which moves the stop 25 to the position shown in FIG. 8. When the stop 25 is in the position shown in FIG. 8 the detent 21 can be moved from the active position. The detent 21 engages the drive member 26 which in turn is connected to the movable member 23 so that movement of the detent 21 from the active positions creates a moment about the axis X-X. Rotation of the movable member 23 about the axis X-X causes the free end of the driven arm 24 to move relative to the stop 25 so that the movable member 23 adopts the second position shown in FIG. 8.

Figure 8:
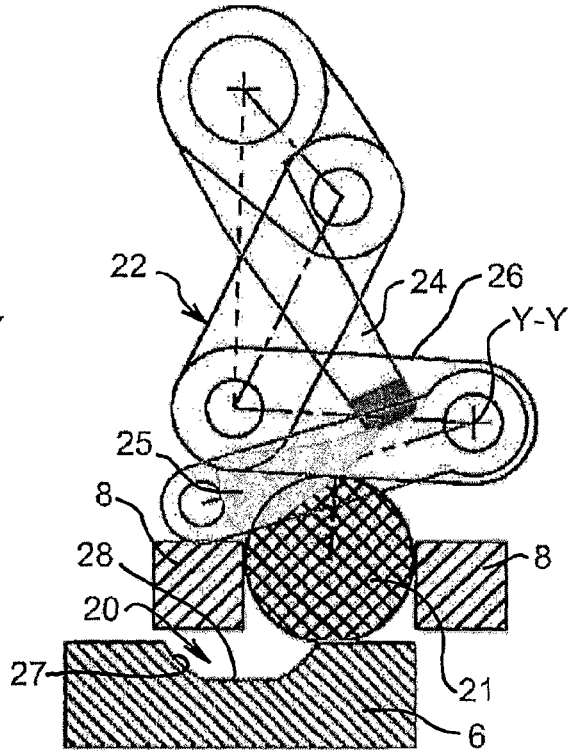
FIG. 8 is a side, elevational diagrammatic view of the retaining means of FIG. 7 in a release condition.

Referring still to FIGS. 7 and 8 which shows the stop 25 being movable about an axis Y-Y. It ought to be noted that the free end of the drive arm 24 when engaging the stop applies a force to the stop 25 that is directed substantially towards this axis Y-Y. This reduces the likelihood of the force Being resisted by another component of the assembly such as the actuator.

The electric strike assembly is configured so that once the retaining means 22 releases the detent 21, the detent 21 is movable from the active position by movement of the keeper 6 relative to the housing 8. This may be achieved in any suitable manner however in the embodiment illustrated particularly with regard to FIG. 8 the recess 20 is preferably frusto conical with a side wall 27 angled relative to a base 28 at approximately 35°. This angle may vary preferably within the range of between 20° to 50°. The detent 21 engages the side wall 27 and the base 28 and when the keeper 6 is moved relative to the housing 8, a force is applied by the side wall 27 to the detent 21 to displace the detent 21 out of the recess 20. The depth of the recess 20 illustrated is less than the radius or half the height of the detent 21. If the depth is greater than that the detent 21 can encounter difficulties when trying to eject from the recess.

Figure 14:
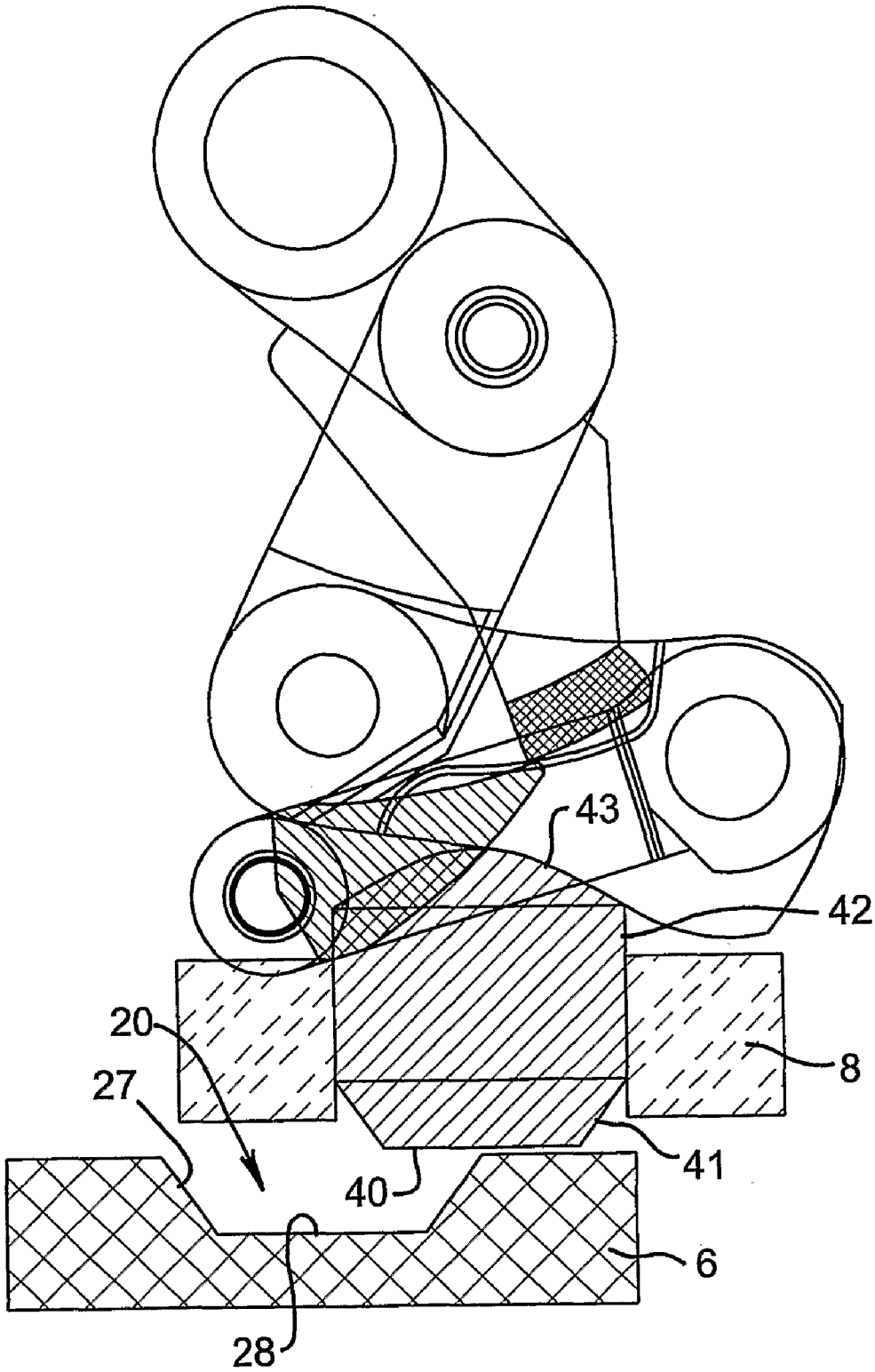
FIG. 14 is a side, elevational diagrammatic view of a alternate preferred embodiment of a locking means of the electric strike assembly of the present invention including a retaining means in a release condition operating in a fail secure mode.

The shape of the detent 21 in FIG. 8 is substantially spherical, however this shape may vary. An alternate embodiment of at least the spherical detent 21 is illustrated in FIG. 14. In this embodiment the detent 21 includes a flat base 40 to seat flush with the base 28 of the recess. A flared portion 41 of the side of the detent 21 flares from the base 40 at an angle that matches the angle of the side wall 27 of the recess 20. This facilitates an accurate location of the detent 21 within the recess 20. A cylindrical portion 42 of the side of the detent 21 is angled to match a side wall of the keeper 8. Again this facilitates an accurate location of the detent 21 within the keeper 8. The detent 21 has an upper surface 43 that is domed to enable the drive member 26 to smoothly slide there over as the detent 21 is displaced from the recess.

Figure 9:
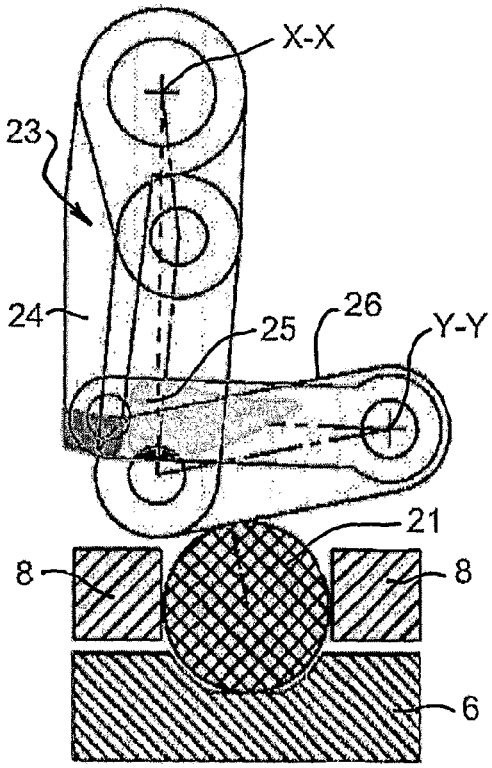
FIG. 9 is a side, elevational diagrammatic view of the locking means of the electric strike assembly of the present invention including the retaining means in a locked condition operating in a fail safe mode.
Figure 10:
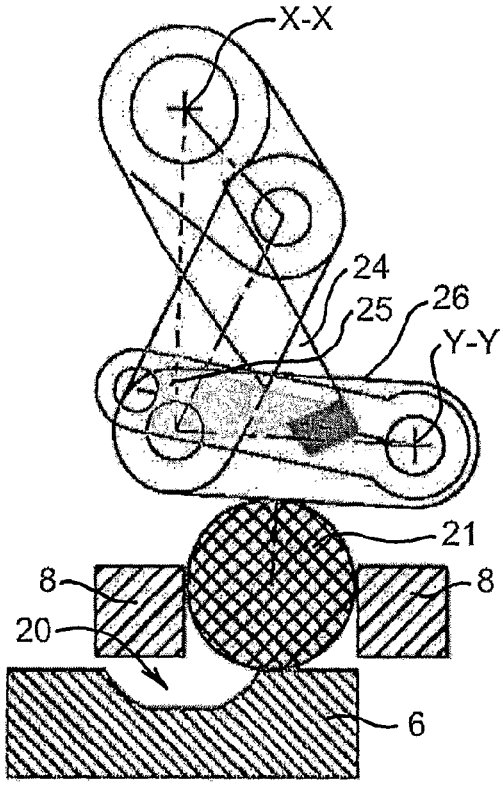
FIG. 10 is a side, elevational diagrammatic view of the retaining means of FIG. 9 in a release condition.

Referring now to FIG. 9 which illustrates the locking means 12 operating in a fail safe mode. It can be noted that comparing FIG. 9 with FIG. 7 that the stop 25 is marginally higher in FIG. 9 than in FIG. 7. This is achieved by lengthening the link arm 17. In order to enable the retaining means 22 to adopt the release condition the actuator must be rendered inoperable which will cause the plunger to move to the extended position. This moves the stop 25 up and out of the way of the free end of the driven arm 24. This in turn enables the movable member 23 to pivot from the first position shown in FIG. 3 to the second position shown in FIG. 10. In this regard the retaining means 22 operates in substantially in the same manner as it did in the fail secure mode. The difference between the two modes is the impact of energization of the solenoid has on the position of the stop.

Figure 11:
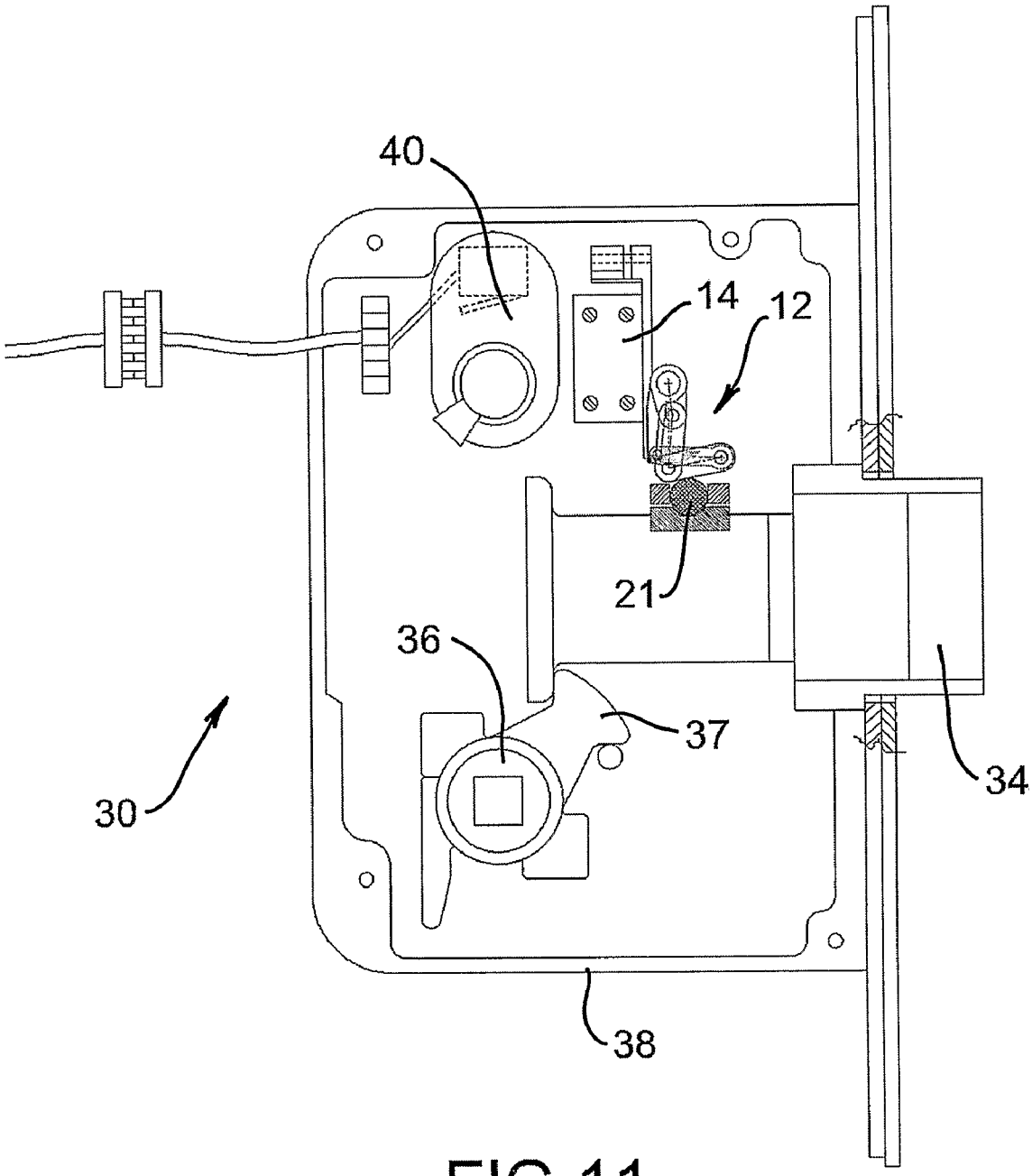
FIG. 11 is a side, elevational cross-sectional view of a preferred embodiment of the locking means of the present invention assembled as part of a mortice lock assembly.

The locking means is not only suitable for application in electric strikes but also other lock assemblies, and in particular electrically controlled lock assemblies. An example of an electrically controlled lock assembly is illustrated in FIG. 11 which is a mortice lock assembly. It must be appreciated that the invention is also applicable to lock assemblies other than mortice lock assemblies such as rim or surface lock assemblies.

The mortice lock assembly 30 illustrated in FIG. 11 includes a bolt 34 mounted on a housing 38 for movement relative to the housing 38. The bolt illustrated is shown in the extended locked position. A hand operable actuator including a hub 36 is provided to retract the bolt 34. The hub 36 is rotatable about an axis into the page and includes a lever arm 37 which engages the bolt 34.

FIG. 11 illustrates the locking means interacting directly with the latch bolt 34. In particular the detent is located in a recess formed in the bolt 34. Operation of the locking means is controlled by the solenoid 14. The solenoid is illustrated as interacting with a cylinder lock assembly 40 however the solenoid may also be controlled through operation of a key tag reader or central control authority.

Figure 13:
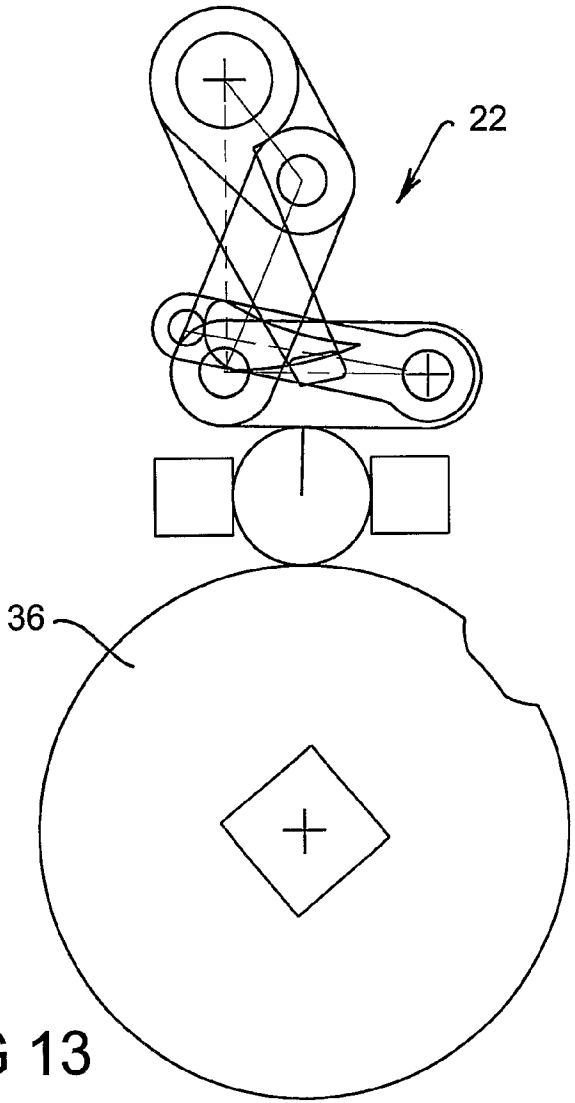
FIG. 13 is a side, elevational diagrammatic view of a preferred embodiment of the locking means of the present invention in an unlocked condition when interacting with a hub of a lock assembly.
Figure 12:
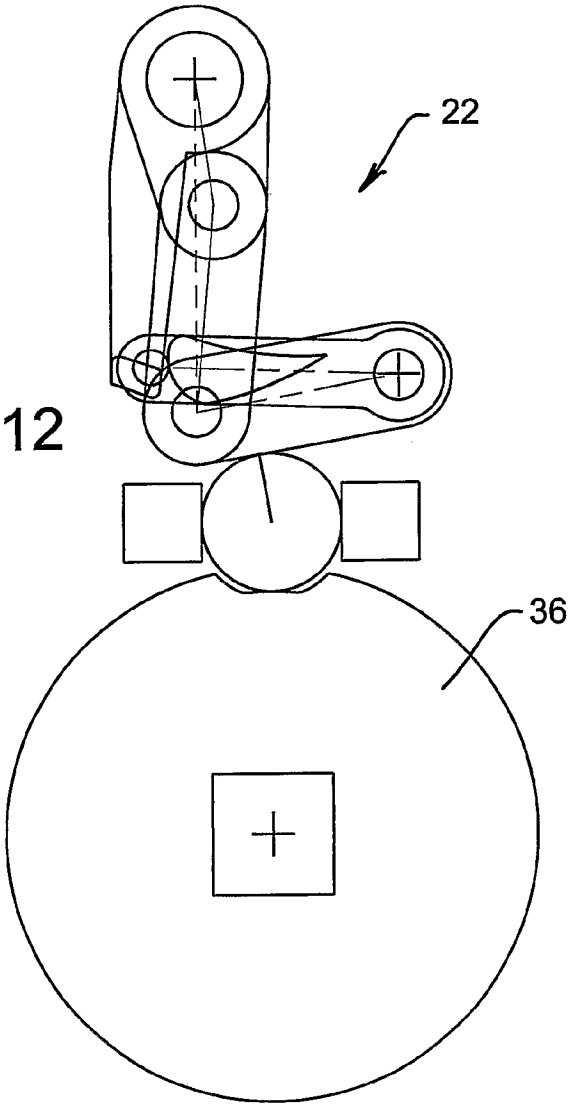
FIG. 12 is a side, elevational diagrammatic view of a preferred embodiment of the locking means of the present invention in a locked condition when interacting with a hub of a lock assembly.

An alternative to interacting directly with the bolt 34 is for the locking means 22 to interact with the hub 36 as shown in FIGS. 12 and 13. Naturally he location of the solenoid arrangement as shown in FIG. 11 will need to change to accommodate interaction with the hub 36.

It will be appreciated from the foregoing description that the present invention provides a lock assembly that requires a relatively simple adjustment o convert between fail safe and fail secure modes of operation. Furthermore, he ability of the detent to be moved from the active position by movement of he keeper once the retaining means is in a release condition it is particularly advantageous. Still furthermore as the response of the retaining means to a reload condition is to urge towards a release condition rather than the locked condition, this will reduce the likelihood of the locking means jamming in a locked condition.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The claims defining the invention are as follows:

1. An electric strike assembly for releasably retaining a bolt including:

a housing, a keeper which in use interacts with the bolt, the keeper being mounted on the housing and being movable relative to the housing from a closed position, locking means including a detent that cooperates with the keeper so that when the detent is retained in an active position the keeper is stopped from being moved from its closed position so that in use the keeper retains the bolt, the locking means including retaining means having locked condition and a released condition, whereby when in the locked condition the retaining means retains the detent in the active position, and when in the released condition the retaining means releases the detent for movement from the active position, the retaining means including a movable member that adopts a first position where the detent is in the active position and moves towards a second position when the detent is moved from the active position, the retaining means also including a stop that obstructs movement of the movable member towards the second position when the retaining means is in the locked condition, and an electrical actuator including a solenoid with a plunger, the plunger being adjustably connectable to the stop so as to allow the locking means to operate in a fail safe mode whereby energization of the actuator causes the retaining means to adopt the locked condition, or after adjustment of the connection of the stop to the plunger to operate in a fail secure mood whereby energization of the actuator causes the retaining means to adopt the released condition, wherein when the retaining means is in the locked condition, urging the keeper to move relative to the housing urges the retaining means to endeavour to adopt the released condition, and wherein when the retaining means is in the released condition the detent is movable from the active position by movement of the keeper relative to the housing from the closed position when releasing the bolt.

2. An electric strike according to claim 1 wherein the movable member pivots about a first axis when moving between the first and second positions.

3. An electric strike according to claim 1 wherein the movable member includes a driven arm that engages the stop when the movable member moves towards the second position and the retaining means is in the locked condition.

4. An electric strike according to claim 3 wherein the driven arm includes a free end that engages the stop when the movable member moves towards the second position and the retaining means is in the locked condition.

5. An electric strike assembly according to claim 3 wherein the stop rotates about a second axis which is parallel with the first axis, and the drive arm when engaging the stop applies a force to the stop that is substantially directed towards the second axis.

6. An electric strike assembly according to claim 5 wherein the retaining means includes a drive member which engages the detent and is connected to the movable member so that movement of the detent from the active position creates a moment around the first axis, the moment having a moment arm which increases as the detent moves from the active position.

7. An electric strike assembly according to claim 6 wherein the drive member is articulated with one end connected to the movable member and the other end connected to the housing for rotation about the second axis.

8. An electric strike assembly according to claim 1 wherein the plunger is adjustably connected to the stop so as to allow adjustment of the position of the stop relative to the free end of the driven arm to adjust the mode of operation of the actuator between fail safe and fail secure.

9. An electric strike assembly according to claim 1 wherein the keeper includes a recess to accommodate the detent when the detent is in the active position.

10. An electric strike assembly according to claim 9 wherein the recess includes an angled side wall that is engaged by the detent when the detent is in the active position, the angle of the side wall being so as to urge the detent out of the recess when the keeper is moved away from the closed position.

11. An electric strike assembly according to claim 1 wherein the keeper is biased towards the closed position.

12. A locking means for use in an electrically controlled lock assembly having a housing and a retainer being mounted on the housing and being movable relative to the housing from a locked position to a released position, the locking means including:

a detent having an active position in which the retainer is stopped from being moved from its locked position, the locking means also including retaining means that when in a locked condition retains the detent in the active position, and when in a released condition releases the detent for movement from the active position, wherein when the retaining means is in the locked condition, urging the retainer to move relative to the housing urges the retaining means to endeavour to adopt the released condition, where the retaining means is in the released condition the detent is movable from the active position by movement of the retainer relative to the housing from the closed position, wherein the retaining means includes a movable member that adopts a first position when the detent is in the active position and moves to a second position when the detent is moved from the active position, the retaining means also including a stop that obstructs movement of the movable member to the second position when the retaining means is in the locked condition, an electrical actuator which interacts with the locking means and is operable to cause the retaining means to adopt the locked condition or the released condition, the electrical actuator including a solenoid with a plunger, the plunger being adjustably connectable to the stop so as to allow the locking means to operate in a fail safe mode whereby energization of the actuator causes the retaining means to adopt the locked condition, or after adjustment of the condition of the stop to the plunger to operate in a fail secure mode whereby energization of the actuator causes the retaining means to adopt the released condition.

13. A locking means according to claim 12 wherein the retainer is a bolt.

14. A locking means according to claim 13 wherein the retainer is a keeper.

15. A locking means according to claim 14 wherein the retaining means includes a movable member that adopts a first position when the detent is in the active position and moves to a second position when the detent is moved from the active position, the retaining means also including a stop that obstructs movement of the movable member to the second position when the retaining means is in the locked condition.

16. An electric strike assembly according to claim 1 including a link arm connecting the stop to the plunger, the link arm being adjustable in length to adjust the mode of operation of the locking means.

17. An electric strike assembly according to claim 16 wherein the adjustment of the link arm involves adjustment of a position of a screw relative to the link arm.

18. A locking means according to claim 12 including a link arm connected to the plunger, the link arm being adjustable in length to adjust the mode of operation of the locking means.

19. A locking means according to claim 18 wherein the adjustment of the link arm involves adjustment of a position of a screw relative to the link arm.

* * * * *

UNITED STATES PATENT AND TRADEMARK OFFICE

CERTIFICATE OF CORRECTION

PATENT NO. : 8,333,411 B2
APPLICATION NO. : 12/309914
DATED : December 18, 2012
INVENTOR(S) : David Blanch It is certified that error appears in the above-identified patent and that said Letters Patent is hereby corrected as shown below:

In the Specification

Column 1, line 41, delete “gins” and insert therefor --pins--.
Column 1, line 43, “Generally” should read --generally--.
Column 1, line 53, “hand operable” should read --hand-operable--.
Column 1, line 61, “hand operable” should read --hand-operable--.
Column 2, line 56, “position” should read --positions--.
Column 2, line 57, after “driven” insert --arm--.
Column 4, line 8, delete “is” and insert therefor --are--.
Column 4, line 25, delete “a” and insert therefor --an--.
Column 4, line 50, delete “a” and insert therefor --an--.
Column 5, line 26, delete “dosed” and insert therefor --closed--.
Column 5, line 42, after “manner” insert --.--.
Column 5, line 43, “however” should read --However--.
Column 6, line 27, “Being” should read --being--.
Column 7, line 6, delete “of” second occurrence.
Column 7, line 19, “hand operable” should read --hand-operable--.
Column 7, line 32, delete “he” and insert therefor --the--.
Column 7, line 37, delete “o” and insert therefor --to--.
Column 7, line 38, delete “he” and insert therefor --the--.
Column 7, line 40, delete “he” and insert therefor --the--.
Column 7, line 40, delete “it”.

Signed and Sealed this
Twenty-first Day of October, 2014

Michelle K. Lee

Michelle K. Lee
*Deputy Director of the United States Patent and Trademark Office*